US008448746B2

(12) United States Patent
Davis, Jr.

(10) Patent No.: US 8,448,746 B2
(45) Date of Patent: May 28, 2013

(54) ROOFER'S CUSHION BRIDGE COMBINATION USING SAME

(76) Inventor: Wendell Davis, Jr., Royal Oak, MI (US)

( * ) Notice: Subject to any disclaimer, the term of this patent is extended or adjusted under 35 U.S.C. 154(b) by 220 days.

(21) Appl. No.: 12/898,773

(22) Filed: Oct. 6, 2010

(65) Prior Publication Data

US 2012/0085590 A1 Apr. 12, 2012

(51) Int. Cl.
*E04D 15/00* (2006.01)

(52) U.S. Cl.
USPC ..... 182/45

(58) Field of Classification Search
USPC ..... 182/230, 45, 200; D29/121.1
See application file for complete search history.

(56) References Cited

U.S. PATENT DOCUMENTS

| | | | | |
|---|---|---|---|---|
| 1,408,253 | A * | 2/1922 | Blank | 280/32.5 |
| 5,546,671 | A | 8/1996 | Kehoe | |
| 5,887,406 | A * | 3/1999 | Bond | 52/749.12 |
| 5,913,782 | A * | 6/1999 | Monaco et al. | 52/126.1 |
| 6,170,222 | B1 * | 1/2001 | Miller | 52/749.12 |
| 6,216,819 | B1 * | 4/2001 | Cougar | 182/45 |
| 6,839,917 | B1 | 1/2005 | Landwehr | |
| 7,409,725 | B1 * | 8/2008 | Horstman | 2/22 |
| 8,104,575 | B1 * | 1/2012 | Bancroft | 182/45 |
| 2007/0205054 | A1 * | 9/2007 | Gentles et al. | 182/230 |
| 2009/0151039 | A1 * | 6/2009 | Kielland | 2/24 |

FOREIGN PATENT DOCUMENTS

| | | | |
|---|---|---|---|
| EP | 710457 | A2 * | 5/1996 |
| GB | 2182087 | A * | 5/1987 |

* cited by examiner

*Primary Examiner* — James O Hansen
*Assistant Examiner* — Kristine Florio
(74) *Attorney, Agent, or Firm* — Young Basile Hanlon & MacFarlane PC

(57) ABSTRACT

A roofer's cushion comprising a tapered block of compliant material, such as closed-cell expanded polystyrene, polyurethane of polyethylene. The block is tapered to compensate to at least some degree to the slope of a roof. A pair of shallow elongate and parallel depressions are formed in the top surface of the block and to accommodate a roofer's knees and lower legs comfortably therein. Additional receptacles of various sizes and locations are provided for tools and materials. A hold-down strap between the depressions uses hook and loop fastener technology to permit a board to be secured to and between two such roofer's cushions to form a ridge structure.

8 Claims, 2 Drawing Sheets

ROOFER'S CUSHION BRIDGE COMBINATION USING SAME

FIELD OF THE INVENTION

This invention relates to a cushion for use in service by roofers and also to a bridge combination using two of the cushions.

BACKGROUND OF THE INVENTION

Installation of shingles and other roofing materials on a sloped roof is a difficult job. Roofer's often use strap-on knee pads to protect their knees during roofing installation work. Published U.S. Application No. 2009/0151039 published Jun. 18, 2009 shows a pair of strap-on knee pads for use by roofers, which knee pads are made of a material such as expanded polystyrene and can be strapped to a roofer's lower legs. The pads are tapered to compensate at least in part for the slope of the roof.

SUMMARY OF THE INVENTION

The present invention provides an improved roofer's cushion which eliminates the need for a strap-on function, accommodates both knees, provides for the temporary storage of tools and other materials and, in the preferred form, can be used to form a convenient and useful bridge structure during a roofing operation.

In accordance with the invention, the cushion comprises a block of compliant material such as, but not limited to, a closed-cell foam plastic with a flat bottom surface adapted to rest on a surface of a roof and an upper or top surface within which a pair of spaced-apart, parallel elongate depressions are formed to receive a roofer's knees and lower legs therein.

The block of material is preferably tapered such that the upper and bottom surfaces are non-parallel, thereby to compensate at least in part for the slope of a roof on which work is being performed. In addition, the preferred embodiment of the invention comprises a plurality of receptacles of various shapes formed in the upper surface of the block to receive and store tools and material. In the most preferred form, the cushion of the subject invention further includes a hold-down strap secured to the upper surface thereof between the roofer's knee depressions such that a 2"×6" board or the like can be strapped to and between the top surfaces of two such cushions to form a bridge structure.

In a practical embodiment, the cushion has a footprint of approximately one square yard; i.e., it is approximately 3'×3' in plan view and approximately 8" thick at the thickest end, tapering to a thickness of about 4" at the opposite end. The hold-down strap is preferably provided with a hook and loop or Velcro® fastener such that it may be stored flat but lifted up to receive a board when the cushion is used to form the bridge structure described above.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
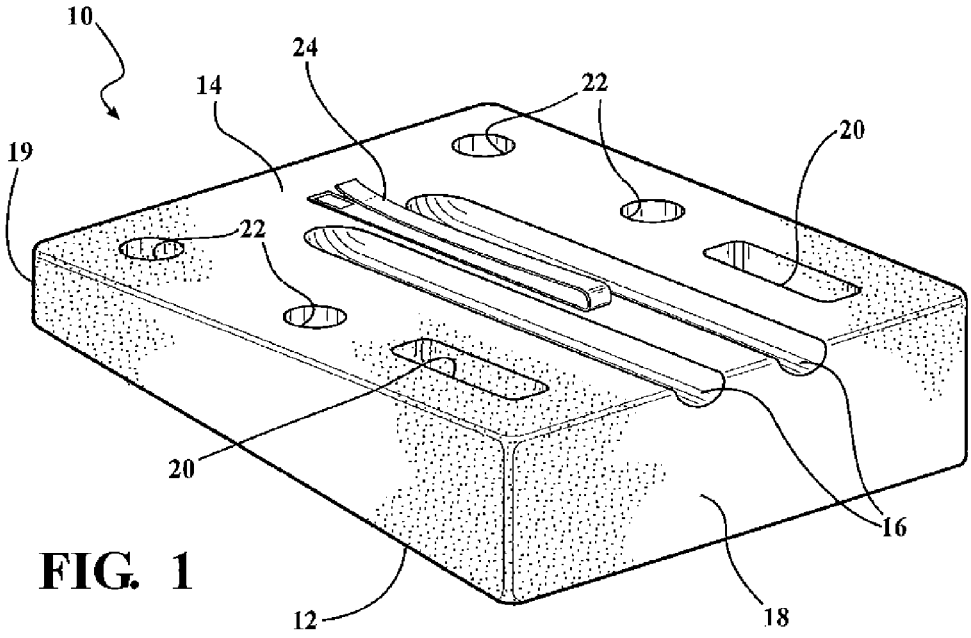
FIG. 1 is a perspective view of a roofer's cushion constructed in accordance with the invention.
Figure 2:
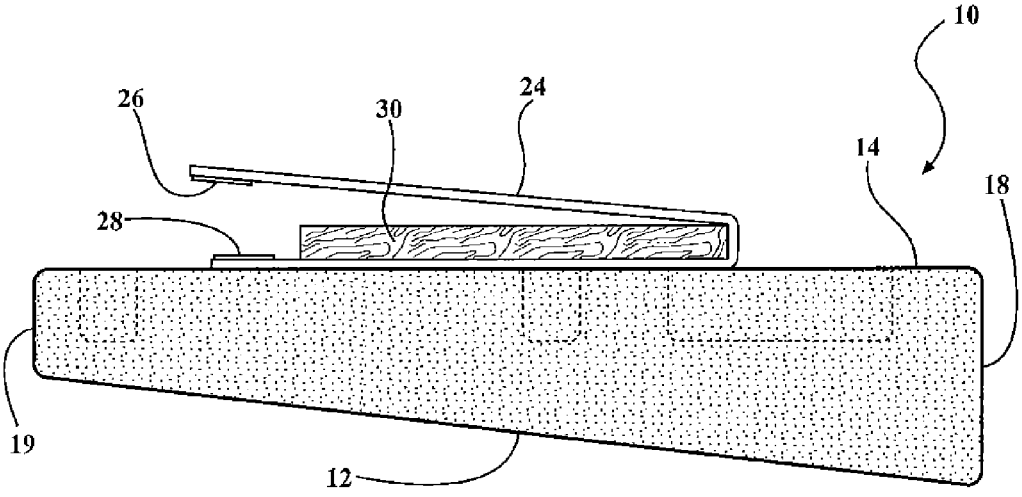
FIG. 2 is a side view of the roofer's cushion of FIG. 1 showing the hold-down strap in a partly-released condition.

Referring to FIGS. 1 and 2, there is shown a roofer's cushion 10 in the form of a block of compliant material such as closed-cell expanded polyethylene, polyurethane or polystyrene. The block 10 has a flat bottom surface 12 and a flat top or upper surface 14 which is non-parallel to the bottom surface 12. Accordingly, the block 10 is tapered between the end surfaces 18, 19. The block 10 is approximately three feet on each side, giving it a footprint of approximately one square yard. The height of the block 10 at surface 18 is approximately 8" and the height of the block at the opposite end 19 is approximately 4". These dimensions are given by way of example and are not intended to be limiting.

A pair of spaced-apart, parallel depressions 16 are formed in the top surface 14 and run from the end 18 toward, but do not reach the opposite end 19. These depressions are sized and spaced apart so as to receive comfortably, the knees and lower legs or portions of the lower legs of a roofer during work installing roofing materials on a sloped roof as hereinafter described with reference to FIG. 3.

In addition to the shallow depressions 16, rectangular receptacles 20 are formed in the block 10 opening to the upper surface 14 on either side of the depressions 16. These receptacles are approximately 5" deep to receive tools or materials so as to help the roofer during the roofing material installation process. In addition, circular receptacles 22 are formed at various locations on opposite sides of the depressions 16 also for the purpose of receiving tools and materials, such as nails, nail puller, jackknives and the like.

Finally, a hold-down strap 24 is secured such as by adhesive to the top surface 14 between and parallel with the depressions 16. The hold-down strap 24 has a top portion and a bottom portion 28, the top portion ending in a tab 26. The top and bottom portions are folded over one another and are adapted to be secured to one another by hook and loop fasteners, also known by the registered trademark Velcro.

In normal use, the block 10 is placed on the surface of a sloped roof and the roofer places his knees and lower legs in the depression 16. Tools and materials may be stored in various receptacles 20, 22 during the roofing process. The hold-down strap may remain flat or closed or may be used to hold articles at the roofer's convenience.

Figure 3:
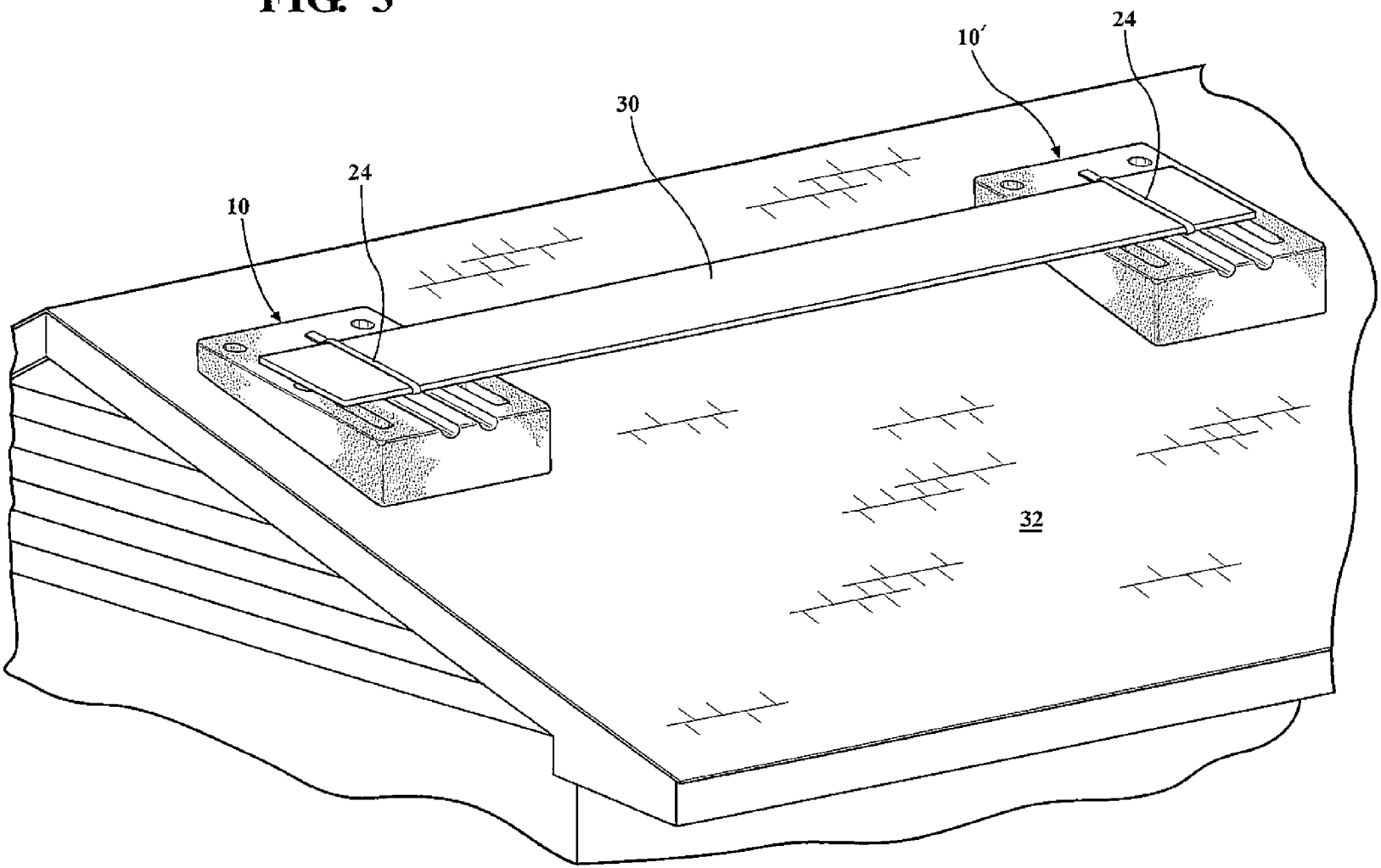
FIG. 3 is a perspective view of the roofer's cushion of FIG. 1 used in combination with a second cushion and a board to form a bridge structure.

Referring to FIG. 3, a second use of the roofer's cushion is shown. In this combination, two roofer's cushions 10, 10' are shown located on the sloping surface of a roof 32 about six feet apart and a board 30 such as an eight-foot 2"×4" board is secured to and between the cushions 10, 10' by way of the hook and loop hold-down straps 24. Of course, this size board is given purely by way of illustration. In the embodiment shown in FIG. 3, use of the board 30 tends to obviate the use of the depressions 16. However, the blocks 10, 10' may be made longer between the surfaces 18, 19 and the hold-down strap 24 moved up so as to leave the depression 16 available for use, even when the bridge structure shown in FIG. 3 has been constructed. The hold-down straps 24 and the board 30 are also located so as to leave at least some of the receptacles 20, 22 open for use by the roofer. While the hold-down strap 24 is shown adhesively secured to the cushion surface, it can also be buried into the cushion material or secured to the cushion in any of several other ways.

It will be understood that the invention has been described with reference to a specific and illustrative embodiment thereof and that various modifications and additions to the invention as disclosed may be possible.

What is claimed is:

1. A roofer's cushion comprising:

a block of compliant material having a flat bottom surface adapted to remain immobile on the surface of a roof in use and a top surface adapted to receive both of a kneeling roofer's knees and lower legs;

a pair of spaced-apart, parallel elongate depressions formed in said top surface to receive both of a kneeling roofer's knees and lower legs therein;

a plurality of receptacles formed in the block outside of said depressions for storing tools and materials; and a hold-down strap fastened to the top surface between and parallel to said depressions.

2. A roofer's cushion as defined in claim 1 wherein the block has a substantially equilateral footprint of approximately one square yard.

3. A roofer's cushion as defined in claim 1 wherein the block is tapered such that the top and bottom surfaces are non-parallel.

4. A roofer's cushion as defined in claim 1 wherein the block is made of a closed cell plastic.

5. A roofer's cushion as defined in claim 1 including a hook and loop type fastener for securing said hold-down strap to itself.

6. In combination:

a pair of blocks of compliant material wherein each block has a flat bottom surface adapted to remain immobile on the surface of a roof in use and a substantially planar top surface adapted to receive both of a kneeling roofer's knees and lower legs which is non-parallel to the bottom surface such that the block is tapered;

a pair of spaced-apart, parallel elongate depressions formed in said top surfaces of each block to receive both of a kneeling roofer's knees and lower legs therein;

each block having secured to the top surface thereof a hold-down strap whereby a board may be secured to and between the top surfaces of said blocks in spaced-apart relationship to form a bridge structure.

7. The combination defined in claim 6 further comprising a plurality of receptacles formed in the top surface of each of said blocks to receive tools and materials.

8. The combination defined in claim 6 wherein the top and bottom surfaces of each block are made of a closed cell plastic and each block has a substantially equilateral footprint on the order of one square yard.

* * * * *